US007999489B2

(12) United States Patent
Zheng et al.

(10) Patent No.: US 7,999,489 B2
(45) Date of Patent: Aug. 16, 2011

(54) CIRCUIT FOR DRIVING LIGHT SOURCES USING BALANCED FEEDBACK SIGNAL

(75) Inventors: Jie-Jian Zheng, Shenzhen (CN); Tong Zhou, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 548 days.

(21) Appl. No.: 12/217,362

(22) Filed: Jul. 2, 2008

(65) Prior Publication Data

US 2009/0009106 A1 Jan. 8, 2009

(30) Foreign Application Priority Data

Jul. 6, 2007 (TW) ..... 96124631 A

(51) Int. Cl.
*H05B 41/36* (2006.01)

(52) U.S. Cl. ..... 315/291; 315/185 R; 315/209 R; 315/210; 315/224; 315/225; 345/102; 345/419

(58) Field of Classification Search ..... 315/185 R, 315/209 R, 210, 224, 225, 226, 291, 299, 315/307, 308, 312, 324, DIG. 2, DIG. 5; 345/102, 419

See application file for complete search history.

(56) References Cited

U.S. PATENT DOCUMENTS

| | | | | |
|---|---|---|---|---|
| 6,420,839 | B1 | 7/2002 | Chiang et al. | |
| 7,375,736 | B2 * | 5/2008 | Kao et al. | 345/419 |
| 7,737,644 | B2 * | 6/2010 | Lu et al. | 315/307 |
| 2004/0100438 | A1 * | 5/2004 | Lee et al. | 345/102 |
| 2008/0067944 | A1 * | 3/2008 | Wang et al. | 315/185 R |

* cited by examiner

*Primary Examiner* — Douglas W Owens
*Assistant Examiner* — Thai Pham
(74) *Attorney, Agent, or Firm* — Altis Law Group, Inc.

(57) ABSTRACT

An exemplary circuit (200) for driving light sources (211, 212, 213, 214) includes feedback circuits (218, 228, 238, 248), a signal balance circuit, and a controller (250). Each feedback circuit corresponds to a light source and is configured for providing a first feedback signal according to a driving current of the light source. The signal balance circuit is configured for balancing all the first feedback signals and correspondingly generating a second feedback signal. The controller is configured for driving the light sources to illuminate according to the second feedback signal.

19 Claims, 2 Drawing Sheets

CIRCUIT FOR DRIVING LIGHT SOURCES USING BALANCED FEEDBACK SIGNAL

FIELD OF THE INVENTION

The present invention relates to a circuit for driving light sources, and more particularly to a circuit capable of adjusting illumination of the light sources according to balanced feedback signal.

GENERAL BACKGROUND

LCDs are widely used in various electronic information devices, such as notebooks, personal digital assistants, video cameras, and the like. A conventional LCD employs a liquid crystal panel to display images. While the liquid crystal panel contains a layer of liquid crystal for generating images, the liquid crystal does not itself generate light. Thus, light sources such as lamps are needed to provide backlight illumination of the liquid crystal.

A conventional circuit for driving the light sources includes a plurality of feedback circuits and a controller having a feedback pin electrically coupled to all the feedback circuits. Each feedback circuit corresponds to a respective light source. In operation, each of the feedback circuits detects a driving current of the corresponding light source, and accordingly generates a feedback current. All the feedback currents are directly received by the feedback pin of the controller simultaneously. The controller further controls illumination of the light sources according to the current received by the feedback pin thereof.

However, when one of the light sources is overloaded, the driving current of the corresponding light source may exceed that of others. This may cause the corresponding feedback current to be relatively higher. Because the controller receives all the feedback currents directly, the anomaly may overwhelm other feedback currents, and become a dominant factor for the illumination controlling of the controller. That is, the controller is liable to control the illumination of all the light sources merely based on the relatively greater feedback current. Thus the reliability of the circuit for driving light sources is affected.

What is needed is to provide a circuit for driving light sources that can overcome the limitations described.

SUMMARY

In one exemplary embodiment, a circuit for driving light sources includes feedback circuits, a current balance circuit, and a controller. Each of the feedback circuits corresponds to a light source and is configured for providing a first feedback signal according to a driving current of the light source. The current balance circuit is configured for balancing all the first feedback signals and correspondingly generating a second feedback signal. The controller is configured for driving the light sources to illuminate according to the second feedback signal.

Other novel features and advantages will become more apparent from the following detailed description when taken in conjunction with the accompanying drawings.

DETAILED DESCRIPTION OF PREFERRED EMBODIMENTS

Reference will now be made to the drawings to describe exemplary embodiments of the present invention in detail.

Figure 1:
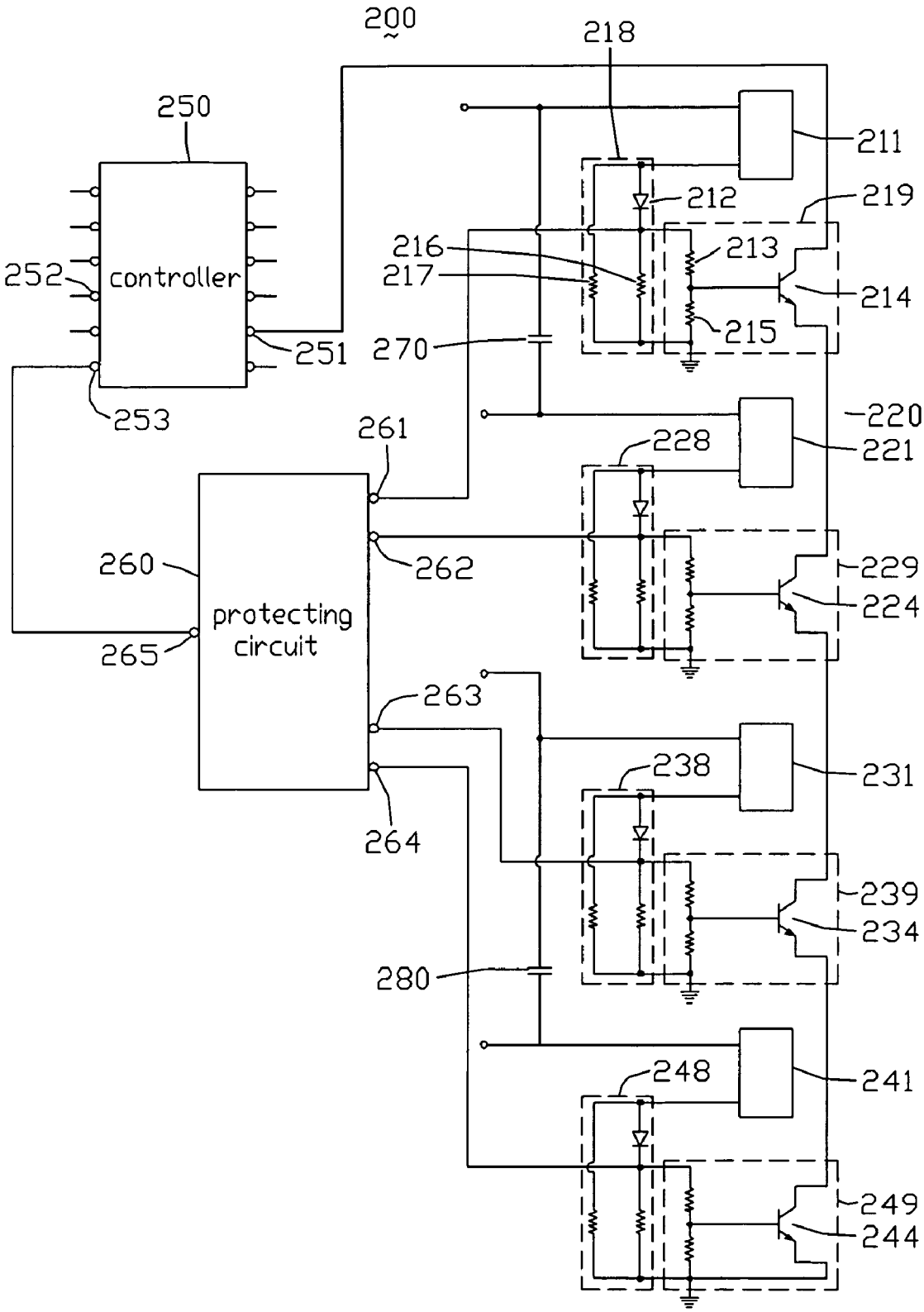
FIG. 1 is a diagram of a circuit for driving light sources according to a first exemplary embodiment of the present invention.

Referring to FIG. 1, a circuit 200 for driving light sources according to a first exemplary embodiment is shown. The number of light sources can be designated as needed. In the present embodiment, four light sources (including a first light source 211, a second light source 221, a third light source 231, and a fourth light source 241) are illustrated, and unless the context indicates otherwise, in the following description it will be assumed that there are only four light sources. The circuit 200 includes a controller 250, a protecting circuit 260, a first feedback circuit 218, a second feedback circuit 228, a third feedback circuit 238, a fourth feedback circuit 238, a first current balance unit 219, a second current balance unit 229, a third current balance unit 239, and a fourth current balance unit 249. The first, second, third, and fourth current balance units 219, 229, 239, 249 cooperatively form a signal balance circuit (not labeled).

The light sources 211, 221, 231, 241 can be lamps such as cold cathode fluorescent lamps (CCFLs). Each of the light sources 211, 221, 231, 241 includes an anode (not labeled) and a cathode (not labeled). The anode receives an alternating current (AC) driving voltage. The cathode is electrically coupled to a corresponding feedback circuit 218, 228, 238, or 248. In addition, the anodes of the first and second light sources 211, 221 are electrically coupled via a first capacitor 270, and the anodes of the third and fourth light sources 231, 241 are electrically coupled via a second capacitor 280.

The first, second, third, and fourth feedback circuits 218, 228, 238, 248 are configured for detecting driving currents of the first, second, third, fourth light sources 211, 221, 231, 241, respectively, and thereby generating four first feedback signals. The first feedback circuit 218 includes a diode 212, a first resistor 216, and a second resistor 217. A positive terminal of the diode 212 is electrically coupled to the cathode of the first light source 211, and a negative terminal of the diode 212 is grounded via the first resistor 216. The second resistor 217 is electrically coupled between the positive terminal of the diode 212 and ground. It should be noted that a similar structure is employed in each of the other feedback circuits 228, 238, 248.

The first, second, third, fourth current balance units 219, 229, 239, 249 are configured for balancing the four first feedback signals respectively provided by the first, second, third, fourth feedback circuits 218, 228, 238, 248, and thereby generating a second feedback signal cooperatively. The first current balance unit 219 includes a first voltage dividing branch (not labeled) and a first current balance member 214. The first voltage dividing branch is configured to provide a bias voltage for the current balance member 214. In particular, the first voltage dividing branch includes a third resistor 213 and a fourth resistor 215 electrically coupled in series between the negative terminal of the diode 212 and ground. The first current balance member 214 can be a negative-positive-negative (NPN) type bipolar junction transistor 214, with a base electrode thereof electrically coupled to a node between the resistors 213, 215.

The second, third, fourth current balance units 229, 239, 249 are similar to the first current balance unit 219. The second current balance unit 229 includes a second voltage dividing branch (not labeled) and a second current balance member 224, the third current balance unit 239 includes a third voltage dividing branch (not labeled) and a third current balance member 234, and the fourth current balance unit 249 includes a fourth voltage dividing branch and a fourth current balance member 244. The first, second, third, fourth current balance members 214, 224, 234, 244 are electrically coupled in series sequentially to form a transistor string. In detail, each collector electrode of the current balance member 224, 234, 244 in the transistor string is electrically coupled to an emitter electrode of a previous current balance member 214, 224, 234. A collector electrode of the foremost transistor in the transistor string (i.e. the first current balance member 214) is electrically coupled to the controller 250 for outputting the second feedback signal. An emitter electrode of the last transistor in the transistor string (i.e. the fourth current balance member 244) is grounded. In addition, each of the base electrodes of the second, third, fourth current balance members 224, 234, 244 is electrically coupled to a corresponding node of the second, third, fourth voltage dividing branch to receive a respective bias voltage.

The controller 250 drives the light sources 211, 212, 213, 214 by adjusting an illumination of each light source 211, 212, 213, 214. The controller 250 includes a first pin 251 for receiving the second feedback signal provided by the current balance circuit, a second pin 252 for receiving an external brightness reference signal, and a third pin 253 for receiving a protecting control signal provided by the protecting circuit 260.

The protecting circuit 260 is an open circuit protecting circuit providing a protecting control signal to the controller 250. The protecting circuit 260 includes a first sampling terminal 261, a second sampling terminal 262, a third sampling terminal 263, a fourth sampling terminal 264, and an output terminal 265. Each of the first, second, third, and fourth sampling terminals 261, 262, 263, 264 samples a corresponding one of the first feedback signals generated by the first, second, third, fourth feedback circuits 218, 228, 238, 248 respectively. The output terminal 265 is configured for outputting the protecting control signal to the second third pin 253 of the controller 250.

In operation, each of the anodes of the first, second, third, fourth light sources 211, 221, 231, 241 receives an AC driving voltage. Thereby, a respective AC driving current is generated and flows through each of the first, second, third, fourth light sources 211, 221, 231, 241, so as to illuminate the corresponding light source 211, 221, 231, or 241.

Each AC driving current is then received by the corresponding feedback circuit 218, 228, 238, 248. In the first feedback circuit 218, the AC driving current is rectified by the diode 212 and converted to a direct current (DC) driving current. Due to the first resistor 216, a DC voltage signal is generated at the negative terminal of the diode 212 in response to the DC driving current. The DC voltage signal serves as a first feedback signal, and is sampled by the first sampling terminal 261 of the protecting circuit 260. Similarly, three other first feedback signals are generated by the second, third, fourth feedback circuits 228, 238, 248 respectively, and are respectively sampled by the second, third, fourth sampling terminals 262, 263, 264 of the protecting circuit 260.

When an open circuit occurs in any of the light sources 211, 221, 231, 241, the corresponding AC driving current is cut off and accordingly the DC voltage signal drops to a low voltage signal (i.e. 0V). Once such low voltage signal is sampled by the corresponding sampling terminal 261, 262, 263, or 264, the protecting circuit 260 generates and outputs a protecting control signal to the controller 250. The controller 250 further directs all the light sources 211, 221, 231, 241 to stop illuminating, to protecting the light sources 211, 221, 231, 241.

When the light sources 211, 221, 231, 241 are in normal working states, operation of the circuit 200 for driving the light sources 211, 221, 231, 241 is illustrated as follow. To simplify the following description, the first feedback circuit 218 and the first current balance unit 219 are taken as an example. In the first feedback circuit 218, the DC voltage signal is divided by the first voltage dividing branch, and thereby a bias voltage is generated at the node between the third resistor 213 and the fourth resistor 215.

The bias voltage causes the first current balance member 214 to be in a desired working state (e.g. a saturation state), such that a first base current $I_{B1}$ is generated and flows to the base electrode of the first current balance member 214. Due to the first base current $I_{B1}$, a first emitter current $I_{E1}$ and a first collector current $I_{C1}$ are respectively generated in the emitter electrode and the collector electrode of the first current balance member 214. Because the first current balance member 214 is an NPN transistor, the relationship between the first base current $I_{B1}$, the first emitter current $I_{E1}$, and the first collector current $I_{C1}$ can be expressed as:

$$I_{E1}=I_{C1}=\beta_1 I_{B1},$$

where $\beta_1$ represents a current coefficient of the transistor. Because the first base current $I_{B1}$ results from the DC voltage signal (i.e. the first feedback signal), a value of the first collector current $I_{C1}$ can be treated as substantially equivalent to the first feedback signal.

Similarly, a second collector current $I_{C2}$ and a second emitter current $I_{E2}$ are generated in the second current balance member 224, a third collector current $I_{C3}$ and a third emitter current $I_{E3}$ are generated in the third current balance member 234, and a fourth collector current $I_{C4}$ and a fourth emitter current $I_{E4}$ are generated in the fourth current balance member 244. Due to the electrical coupling between the current balance members 214, 224, 234, 244, the relationship between the collector currents $I_{C1}$, $I_{C2}$, $I_{C3}$, $I_{C4}$ can be expressed as $I_{C1}=I_{E1}=I_{C2}=I_{E2}=I_{C3}=I_{E3}=I_{C4}=I_{E4}$. That is, all the collector currents $I_{C1}$, $I_{C2}$, $I_{C3}$, $I_{C4}$ are balanced. Because each of the collector currents $I_{C1}$, $I_{C2}$, $I_{C3}$, $I_{C4}$ is equivalent to the corresponding first feedback signals, it is indicated that all the first feedback signals are balanced by the cooperation of the first, second, third, fourth current balance members 214, 224, 234, 244. The balanced collector current serves as a second feedback signal, and is outputted to the controller 250 via the collector electrode of the first current balance member 214.

The controller 250 receives an external brightness reference signal via the second pin 252 thereof, and compares the second feedback signal with the external brightness reference signal. The controller 250 further adjusts the AC driving voltage according to a result of the comparison, such that the illumination of the light sources 211, 212, 213, 214 is adjusted.

In summary, the circuit 200 employs the feedback circuits 218, 228, 238, 248 to provide the first feedback signals according to the driving currents of the light sources 211, 221, 231, 241 and employs the signal balance circuit to balance all the first feedback signals and correspondingly generate the second feedback signal. Further, the controller 250 drives the light sources 211, 221, 231, 241 according to the second feedback signal. It is noted that the driving currents of the light sources 211, 221, 231, 241 indicate the illumination of the light sources 211, 221, 231, 241. Because the first feedback signals are balanced before outputted to the controller 250, the controller 250 is capable of driving the light sources 211, 221, 231, 241 by considering the illumination of all the light sources 211, 221, 231, 241, even if one of the driving currents may be relatively greater than and overwhelm others. Thus the reliability of the circuit 200 for driving the light sources 211, 221, 231, 241 is more reliable.

Figure 2:
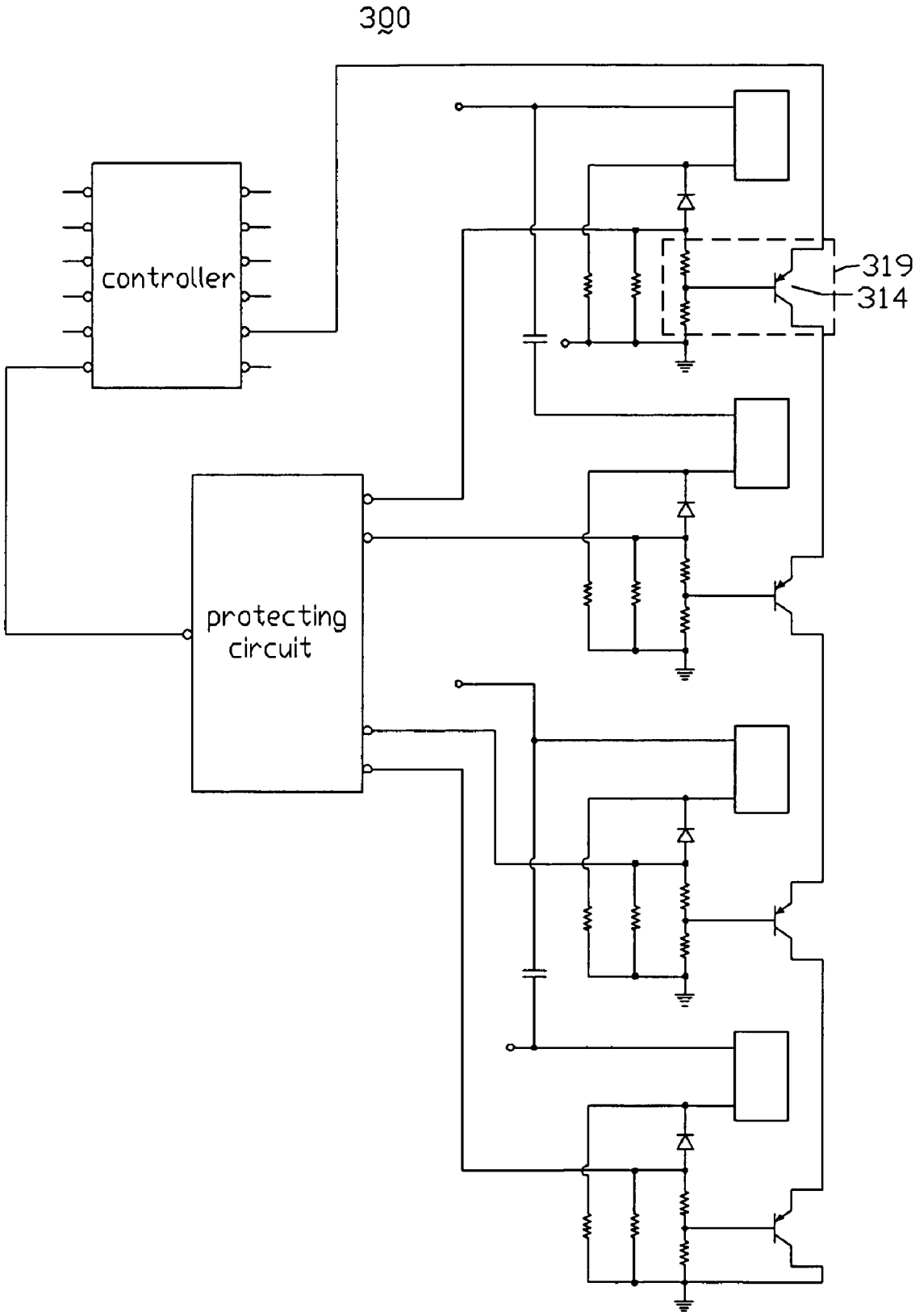
FIG. 2 is a diagram of a circuit for driving light sources according to a second exemplary embodiment of the present invention.

FIG. 2 is a diagram of a circuit 300 for driving light sources according to a second exemplary embodiment of the present invention. The circuit 300 is similar to the above-described circuit 200, differing only in the circuit 300 including a current balance circuit (not labeled) having a plurality of current balance units 319. Each current balance unit 319 includes a current balance member 314. The current balance member 314 is a positive-negative-positive (PNP) bipolar junction transistor.

It is to be further understood that even though numerous characteristics and advantages of preferred and exemplary embodiments have been set out in the foregoing description, together with details of structures and functions associated with the embodiments, the disclosure is illustrative only; and that changes may be made in detail (including in matters of arrangement of parts) within the principles of the invention to the full extent indicated by the broad general meaning of the terms in which the appended claims are expressed.

What is claimed is:

1. A circuit for driving light sources, comprising:

a plurality of feedback circuits, each of which corresponding to a light source and being configured for providing a first feedback signal according to a driving current of the light source;

a signal balance circuit configured for balancing all the first feedback signals and correspondingly generating a second feedback signal; and a controller configured for driving the light sources to illuminate according to the second feedback signal;

wherein the signal balance circuit comprises a plurality of current balance units, each of the current balance units corresponds to a feedback circuit, and comprises a voltage dividing branch and a current balance member, the voltage dividing branch is configured to provide a bias voltage signal to the current balance unit, the current balance members of the current balance units are electrically coupled in series between the controller and ground.

2. The circuit for driving light sources of claim 1, wherein the feedback circuit is configured to convert the driving current of the corresponding light source to the first feedback signal.

3. The circuit for driving light sources of claim 2, wherein the feedback circuit comprises a diode and a first resistor, a positive terminal of the diode is electrically coupled to the corresponding light source, and a negative terminal of the diode is grounded via the first resistor.

4. The circuit for driving light sources of claim 3, wherein the feedback circuit further comprises a second resistor, the second resistor is electrically coupled between the positive terminal of the diode and ground.

5. The circuit for driving light sources of claim 1, wherein the bias voltage signal is generated by dividing the first feedback signal.

6. The circuit for driving light sources of claim 1, wherein the current balance member is an NPN type transistor, a base electrode of the current balance member is configured to receive the bias voltage signal, and an emitter electrode of the previous current balance member is electrically coupled to a collector electrode of the latter current balance member.

7. The circuit for driving light sources of claim 6, wherein a collector of the foremost current balance member is electrically coupled to the controller to output the second feedback signal.

8. The circuit for driving light sources of claim 6, wherein an emitter of the backmost current balance member is grounded.

9. The circuit for driving light sources of claim 1, further comprising a protecting circuit configured for protecting the light sources according to the first feedback signals.

10. The circuit for driving light sources of claim 9, wherein the protecting circuit comprises a plurality of sampling terminals, each configured to sample a first feedback signal.

11. The circuit for driving light sources of claim 10, wherein the protecting circuit further comprises an output terminal, the output terminal is configured to output a protecting control signal to the controller according to the result of the sampling.

12. The circuit for driving light sources of claim 1, wherein the controller drives the light sources by comparing the second feedback signal and an external brightness reference signal.

13. A circuit for driving light sources, comprising:

a plurality of feedback circuits, each of which corresponding to a light source and being configured for providing a first feedback signal according to an illumination of the light source;

at least one signal balance circuit configured for balancing all the first feedback signals and correspondingly generating a second feedback signal; and a controller configured for adjusting driving currents of the light sources according to the second feedback signal;

wherein the at least one signal balance circuit comprises a plurality of current balance units, each current balance unit comprises a current balance member, the current balance members of the current balance units are electrically coupled in series between the controller and ground;

wherein the signal balance circuit further comprises a plurality of voltage dividing branches, each of the voltage dividing branches corresponding to a current balance member and is configured to provide a bias voltage to the current balance member.

14. The circuit for driving light sources of claim 13, wherein each of the current balance units is electrically coupled to a feedback circuit.

15. The circuit for driving light sources of claim 13, wherein each of the current balance units receives a corresponding one of the first feedback signal from the corresponding feedback circuit, and all the current balance units cooperatively balance the first feedback signals.

16. The circuit for driving light sources of claim 13, wherein the controller driving the light sources by comparing the second feedback signal and an external brightness reference signal.

17. An apparatus for driving light sources, comprising:

a plurality of feedback circuits, each of which being configured for feeding back a driving signal of a light source and generating a feedback signal;

a signal balance circuit configured for balancing the feedback signals provided by the plurality of feedback circuits, and correspondingly generating a balanced signal; and a controller comprising a receiving terminal for receiving the balanced signal, the controller being configured for comparing the balanced signal with a reference signal, and adjusting the driving signals of the light sources according to a result of the comparison;

wherein the signal balance circuit comprises a plurality current balance members electrically coupled in series to form a string, the receiving terminal of the controller is grounded via the string form by the current balance members;

wherein the signal balance circuit further comprises a plurality of voltage dividing branches, each of the voltage dividing branches corresponding to a current balance member and is configured to provide a bias voltage to the current balance member.

18. The apparatus of claim 17, wherein each current balance member is a transistor and the plurality of each current balance member cooperatively form a transistor string, wherein a base electrode of each transistor is configured to receive the bias voltage signal provided by a corresponding one of the voltage dividing branches, and an emitter electrode of a previous transistor in the transistor string is electrically coupled to a collector electrode of a latter transistor in the transistor string.

19. The apparatus of claim 17, wherein a collector of a foremost transistor in the transistor string is electrically coupled to the controller, and is configured to output the balanced signal to the controller, and an emitter of a backmost transistor in the transistor string is grounded.

* * * * *